US006112422A

United States Patent [19]

Laiche, Jr.

[11] Patent Number: 6,112,422

[45] Date of Patent: Sep. 5, 2000

[54] SPLIT LEAF REAR OPEN SIGHT

[76] Inventor: Lawrence J. Laiche, Jr., 406-E Airline Hwy., Gramercy, La. 70052

[21] Appl. No.: 09/146,561

[22] Filed: Sep. 3, 1998

[51] Int. Cl.[7] ..... F41G 1/02

[52] U.S. Cl. ..... 33/252; 33/257

[58] Field of Search ..... 33/233, 252, 257, 33/258; 42/100

[56] References Cited

U.S. PATENT DOCUMENTS

| | | | |
|---|---|---|---|
| 280,484 | 7/1883 | Kelton | 33/257 |
| 428,458 | 5/1890 | Cochan et al. | 33/252 |
| 496,051 | 4/1893 | Freund | 33/233 |
| 875,016 | 12/1907 | Phair | 42/100 |
| 1,318,423 | 10/1919 | Williams | 42/100 |
| 2,336,108 | 12/1943 | Lowe | 33/258 |
| 3,834,035 | 9/1974 | Merrill | 33/258 |
| 4,017,995 | 4/1977 | Hughes, Jr. | 42/100 |

FOREIGN PATENT DOCUMENTS

| | | | |
|---|---|---|---|
| 10607 | 6/1902 | United Kingdom | 42/100 |
| 7282 | 6/1903 | United Kingdom | 33/257 |
| 11081 | 3/1906 | United Kingdom | 33/257 |

*Primary Examiner*—Charles T. Jordan
*Assistant Examiner*—Denise J Buckley

[57] ABSTRACT

A split leaf rear open sight is provided including a gun and a mounting assembly coupled to a top surface of a rear extent of the gun. A pair of pieces are provided at least one of which has a beveled edge and is horizontally slidable with respect to the other piece for adjusting a sight defined by the pieces.

8 Claims, 3 Drawing Sheets

SPLIT LEAF REAR OPEN SIGHT

BACKGROUND OF THE INVENTION

1. Field of the Invention

The present invention relates to adjustable gun sights and more particularly pertains to a new split leaf rear open sight for adjusting a gun sight both vertically and horizontally in an effective manner.

2. Description of the Prior Art

The use of adjustable gun sights is known in the prior art. More specifically, adjustable gun sights heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable gun sights include U.S. Pat. No. 4,551,920; U.S. Pat. No. 4,200,989; U.S. Pat. No. 4,479,307; U.S. Pat. Des. 382,038; U.S. Pat. Des. 361,366; and U.S. Pat. No. 2,264,809.

In these respects, the split leaf rear open sight according to the present invention substantially departs from the conventional concepts and designs of the prior art, and in so doing provides an apparatus primarily developed for the purpose of adjusting a gun sight both vertically and horizontally in an effective manner.

SUMMARY OF THE INVENTION

In view of the foregoing disadvantages inherent in the known types of adjustable gun sights now present in the prior art, the present invention provides a new split leaf rear open sight construction wherein the same can be utilized for adjusting a gun sight both vertically and horizontally in an effective manner.

The general purpose of the present invention, which will be described subsequently in greater detail, is to provide a new split leaf rear open sight apparatus and method which has many of the advantages of the adjustable gun sights mentioned heretofore and many novel features that result in a new split leaf rear open sight which is not anticipated, rendered obvious, suggested, or even implied by any of the prior art adjustable gun sights, either alone or in any combination thereof.

To attain this, the present invention is adapted for use with a gun having a laterally extending dovetail recess formed in a top surface of a rear extent thereof. The present invention includes a mounting assembly having a horizontally oriented, rectangular base strip defined by a top face, a bottom face and a periphery formed therebetween. The mounting assembly further includes a dovetail protrusion integrally mounted along a length of the bottom face of the base strip for being removably engaged with the dovetail recess of the gun. As best shown in FIGS. 1 & 2, a pair of upstanding stanchions of the mounting assembly are integrally coupled to the top face of the base strip at ends thereof. Each of such stanchions include a threaded bore formed therein about an axis parallel with that defined by the base strip. In use, the threaded bore of each stanchion serves for receiving a lateral set screw. For receiving a locking screw, a threaded recess is formed in the top face of the base strip at a central extent thereof about a vertical axis. Note FIG. 4. Next provided is a pair of adjustment pieces each having an upper extent with a planar, right triangular configuration. A planar rectangular lip is integrally coupled to a bottom edge of the upper extent of each piece. The lip remains in perpendicular relationship with the upper extent of the associated piece. Each piece further includes an elongated slot formed in the lip along a length thereof. A block is mounted on the lip adjacent to a vertical edge of the piece with a bore formed therein. As shown in the various Figures, the lips of the pieces are slidably situated on the top face of the base strip. The upper extents of the pieces are maintained in coplanar sliding abutment. As such, hypotenuse edges of the pieces define a sight. The aforementioned set screws each rotatably engage the bore of the block of one of the pieces. Further, the locking screw is situated through the slots of the lips of the pieces. By this structure, the sight may be adjusted both vertically and laterally by sliding the pieces either together or individually via the set screws. Thereafter, pieces may be locked in place by way of the locking screw.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new split leaf rear open sight apparatus and method which has many of the advantages of the adjustable gun sights mentioned heretofore and many novel features that result in a new split leaf rear open sight which is not anticipated, rendered obvious, suggested, or even implied by any of the prior art adjustable gun sights, either alone or in any combination thereof.

It is another object of the present invention to provide a new split leaf rear open sight which may be easily and efficiently manufactured and marketed.

It is a further object of the present invention to provide a new split leaf rear open sight which is of a durable and reliable construction.

An even further object of the present invention is to provide a new split leaf rear open sight which is susceptible of a low cost of manufacture with regard to both materials and labor, and which accordingly is then susceptible of low prices of sale to the consuming public, thereby making such split leaf rear open sight economically available to the buying public.

Still yet another object of the present invention is to provide a new split leaf rear open sight which provides in the apparatuses and methods of the prior art some of the advantages thereof, while simultaneously overcoming some of the disadvantages normally associated therewith.

Still another object of the present invention is to provide a new split leaf rear open sight for adjusting a gun sight both vertically and horizontally.

Even still another object of the present invention is to provide a new split leaf rear open sight for use with a gun and a mounting assembly coupled to a top surface of a rear extent of the gun. A pair of pieces are provided at least one of which has a beveled edge and is horizontally slidable with respect to the other piece for adjusting a sight defined by the pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
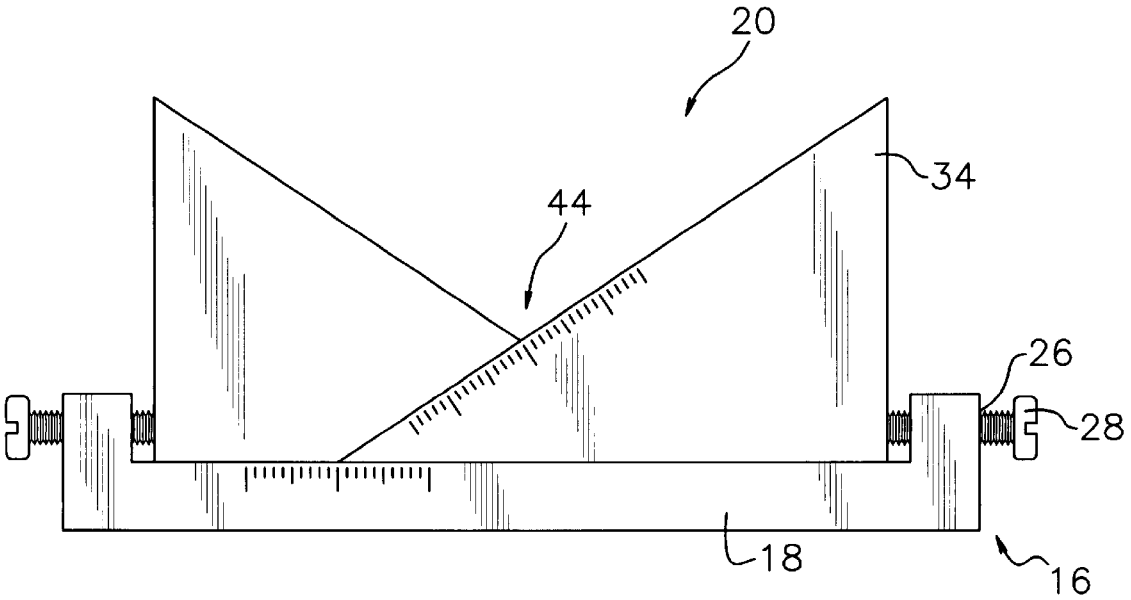
FIG. 1 is a front view of a new split leaf rear open sight according to the present invention.

With reference now to the drawings, and in particular to FIGS. 1 through 6 thereof, a new split leaf rear open sight embodying the principles and concepts of the present invention and generally designated by the reference numeral 10 will be described.

The present invention, designated as numeral 10, is adapted for use with a gun 12 having a laterally extending dovetail recess 14 formed in a top surface of a rear extent thereof. The present invention includes a mounting assembly 16 having a horizontally oriented, rectangular base strip 18 defined by a top face, a bottom face and a periphery formed therebetween. The mounting assembly further includes a dovetail protrusion 20 integrally mounted along a length of the bottom face of the base strip for being removably engaged with the dovetail recess of the gun.

Figure 2:
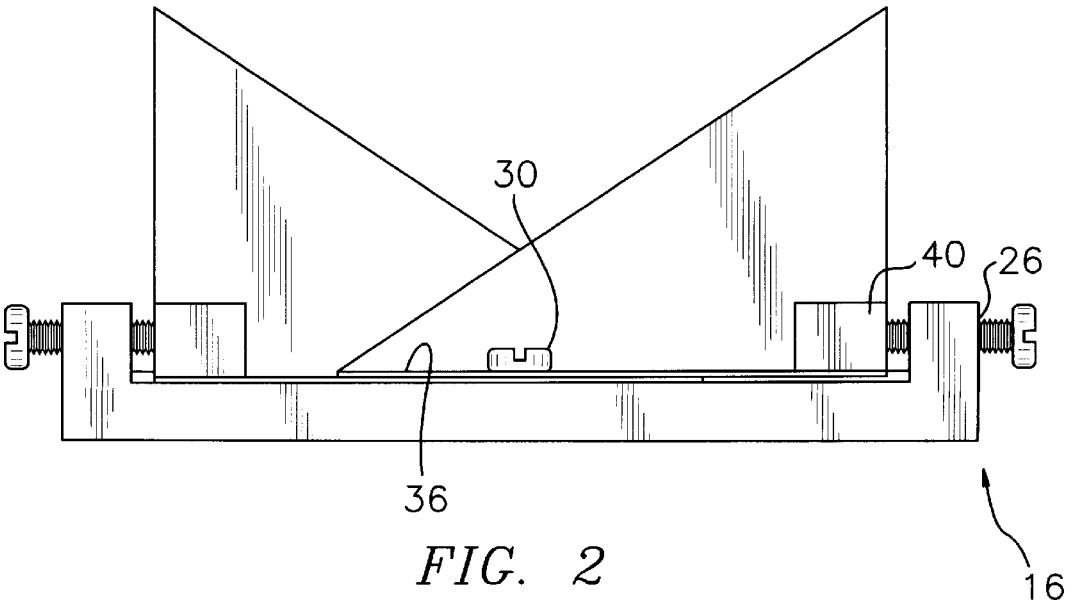
FIG. 2 is a rear view of the present invention.
Figure 3:
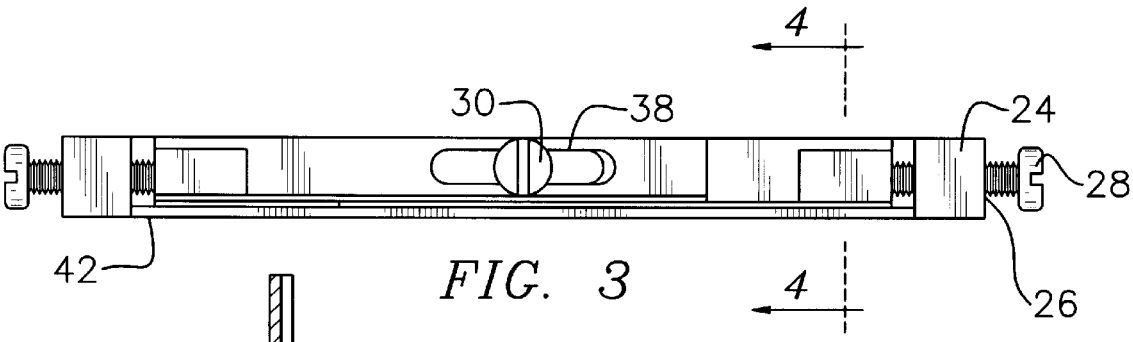
FIG. 3 is a top view of the present invention.
Figure 4:
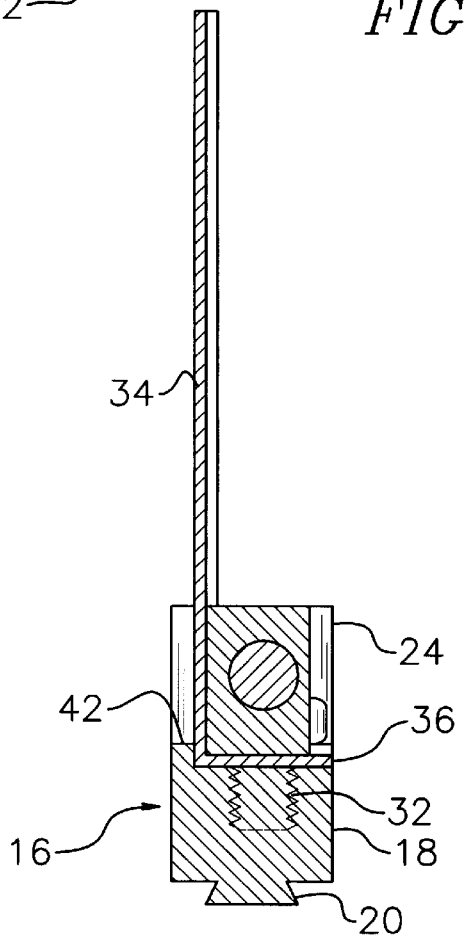
FIG. 4 is a side cross-sectional view of the present invention taken along line 4—4 shown in FIG. 3.
Figure 5:
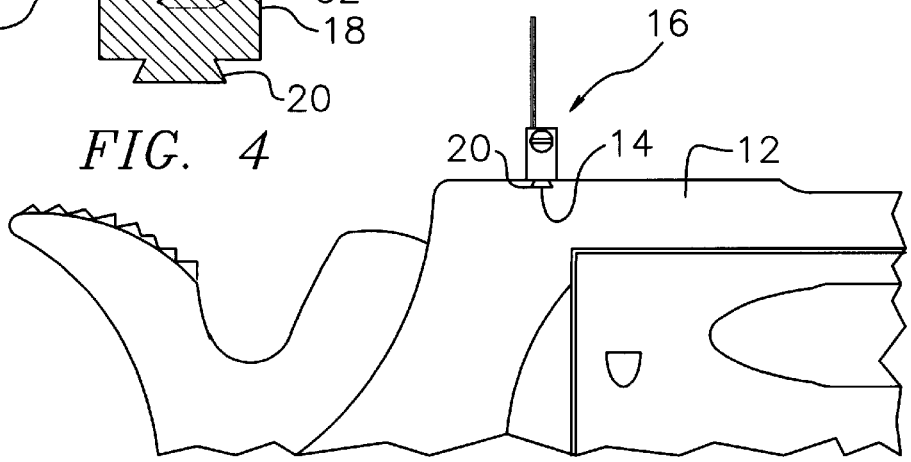
FIG. 5 is a side view of the present invention during use.

As best shown in FIGS. 1 & 2, a pair of upstanding stanchions 24 of the mounting assembly are integrally coupled to the top face of the base strip at ends thereof. Each of such stanchions include a threaded bore 26 formed therein about an axis parallel with that defined by the base strip. In use, the threaded bore of each stanchion serves for receiving a lateral set screw 28. For receiving a locking screw 30, a threaded recess 32 is formed in the top face of the base strip at a central extent thereof about a vertical axis. Note FIG. 4.

Next provided is a pair of adjustment pieces 34 each having an upper extent with a planar, right triangular configuration. A planar rectangular lip 36 is integrally coupled to a bottom edge of the upper extent of each piece. The lip remains in perpendicular relationship with the upper extent of the associated piece. Each piece further includes an elongated slot 38 formed in the lip along a length thereof. A block 40 is mounted on the lip adjacent to a vertical edge of the piece. Such block is equipped with a horizontally oriented bore.

As shown in the various Figures, the lips of the pieces are slidably situated on the top face of the base strip. The upper extents of the pieces are maintained in coplanar sliding abutment. Ideally, an upwardly extending flange 42 is formed along an inboard edge of the top face of the base strip of the mounting assembly. This flange is slidably abutted by the pieces for maintaining the same properly positioned. During operation, hypotenuse edges of the pieces define a sight 44. The aforementioned set screws each rotatably engage the bore of the block of one of the pieces. This may be accomplished by way of an annular indent/detent combination or the like. Further, the locking screw is situated through the slots of the lips of the pieces and in engagement with the base strip.

Figure 6:
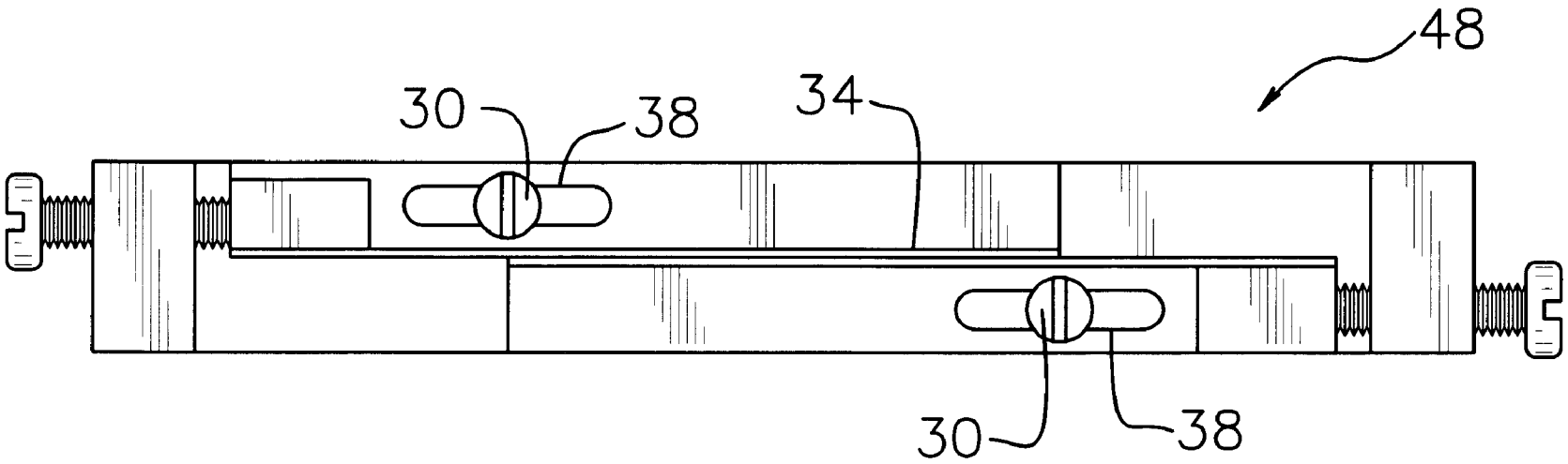
FIG. 6 is a top view of an alternate embodiment of the present invention.

By this structure, the sight may be adjusted both vertically and laterally by sliding the pieces either together or individually via the set screws. Thereafter, pieces may be locked in place by way of the locking screw. For gauging the adjustment of the sight, indicia 46 is preferably positioned along the hypotenuse edge of one of the pieces and further along one side of the periphery of the base strip. In an alternate embodiment 48, the lips of the pieces may extend in opposite directions, as shown in FIG. 6. As such, a pair of locking screws may be provided for independently locking the pieces.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A split leaf rear open sight comprising, in combination:

a gun having a laterally extending dovetail recess formed in a top surface of a rear extent thereof;

a mounting assembly including a horizontally oriented base strip defined by a top face, a bottom face and a periphery formed therebetween, the mounting assembly further including a dovetail protrusion integrally mounted along a length of the bottom face of the base strip for being removably engaged with the dovetail recess of the gun, a pair of upstanding stanchions integrally coupled to the top face of the base strip at ends thereof and each including a threaded bore formed therein about an axis parallel with that defined by the base strip for receiving a lateral set screw, and a threaded recess formed in the top face of the base strip at a central extent thereof about a vertical axis for receiving a locking screw; and a pair of adjustment pieces each having an upper extent with a planar, right triangular configuration, a planar rectangular lip integrally coupled to a bottom edge of the upper extent of the piece in perpendicular relationship therewith, an elongated slot formed in the lip along a length thereof, and a block mounted on the lip adjacent to a vertical edge of the piece with a bore formed therein;

wherein the lips of the pieces are slidably situated on the top face of the base strip with the upper extents of the pieces being in sliding abutment in coplanar relationship such that hypotenuse edges of the pieces define a sight and further wherein the set screws each rotatably engage the bore of the block of one of the pieces and the locking screw is situated through the slots of the lips of the pieces, whereby the sight may be adjusted both vertically and laterally by sliding the pieces either together or individually via the set screws and thereafter locked in place by way of the locking screw.

2. A split leaf rear open sight for mounting on a gun, the open sight comprising:

a mounting assembly adapted for coupling to a top surface of a gun, the mounting assembly having a top surface; and a pair of sighting pieces mounted on the mounting assembly adjacent to each other, each of the pieces having a sight edge oriented at an acute angle with respect to the top surface, the sight edges of the pieces having a visual convergence defining a vertex, the pieces being independently laterally moveable with respect to each other in a direction substantially parallel to the top surface such that movement of one piece with respect to the other piece moves the vertex both in a vertical sighting direction and in a horizontal sighting direction.

3. The split leaf rear open sight as set forth in claim 2 wherein each of the pieces has an upper extent, the upper extent having a triangular shape with a hypotenuse of the triangular shape forming one of the sight edges.

4. The split leaf rear open sight as set forth in claim 2 wherein the pieces are locked against movement relative to each other by a single locking screw.

5. The split leaf rear open sight as set forth in claim 2 wherein the pieces are positioned independently of each other by a pair of positioning screws, each of the positioning screws bearing on one of the pieces.

6. The split leaf rear open sight as set forth in claim 2 wherein the at least one piece is locked via a locking screw.

7. A split leaf rear open sight comprising:

a mounting assembly including a horizontally oriented base strip defined by a top face, a bottom face and a periphery formed therebetween, the mounting assembly further including a dovetail protrusion integrally mounted along a length of the bottom face of the base strip for being removably engaged with the dovetail recess of a gun, a pair of upstanding stanchions coupled to the top face of the base strip at ends of the base strip, each strip including a threaded bore formed therein about an axis substantially parallel with an axis defined by the base strip for, the bore being adapted for receiving a lateral set screw, and a threaded recess formed in the top face of the base strip for receiving a locking screw; and a pair of adjustment pieces each having an upper extent with a substantially triangular perimeter configuration, a lip integrally coupled to a bottom edge of the upper extent of the piece and extending in substantially perpendicular relationship with respect to the upper extent, an elongated slot formed in the lip along a length thereof, and a block mounted on the lip adjacent to an outer edge of the piece with a bore formed therein;

wherein the lips of the pieces are slidably situated on the top face of the base strip with the upper extents of the pieces being positioned adjacent to each other such that hypotenuse edges of the pieces define a vertex, the set screws each rotatably engaging the bore of the block of one of the pieces and the locking screw extends through the slots of the lips of the pieces, whereby the vertex may be adjusted both vertically and laterally by sliding the pieces either together or individually via the set screws and thereafter locking in place by way of the locking screws.

8. The open sight of claim 7, additionally comprising a gun having a laterally extending dovetail recess formed in a top surface of a rear extent thereof.

* * * * *